US008603603B2

(12) United States Patent
Meyer et al.

(10) Patent No.: US 8,603,603 B2
(45) Date of Patent: Dec. 10, 2013

(54) CORROSION INHIBITING SYSTEMS

(75) Inventors: Jessica Jackson Meyer, Hudson, WI (US); Margarita Kharshan, Little Canada, MN (US); Boris A. Miksic, North Oaks, MN (US)

(73) Assignee: Cortec Corporation, St. Paul, MN (US)

( * ) Notice: Subject to any disclaimer, the term of this patent is extended or adjusted under 35 U.S.C. 154(b) by 416 days.

(21) Appl. No.: 13/022,401

(22) Filed: Feb. 7, 2011

(65) Prior Publication Data

US 2012/0201996 A1 Aug. 9, 2012

(51) Int. Cl.
*B32B 1/06* (2006.01)

(52) U.S. Cl.
USPC ..... 428/69; 428/68

(58) Field of Classification Search
USPC ..... 428/69, 68
See application file for complete search history.

(56) References Cited

U.S. PATENT DOCUMENTS

| | | | | |
|---|---|---|---|---|
| 3,513,609 | A | 5/1970 | Lang | |
| 3,979,896 | A | 9/1976 | Klett et al. | |
| 4,442,021 | A | 4/1984 | Burge et al. | |
| 4,840,666 | A | 6/1989 | Schmidt et al. | |
| 4,869,752 | A | 9/1989 | Jaklin | |
| 5,079,879 | A | 1/1992 | Rodriguez | |
| 5,139,700 | A | 8/1992 | Miksic et al. | |
| 5,218,011 | A | 6/1993 | Freeman | |
| 5,460,033 | A * | 10/1995 | Vander Velde | 73/86 |
| 5,540,030 | A | 7/1996 | Morrow | |
| 5,597,514 | A | 1/1997 | Miksic et al. | |
| 5,750,053 | A | 5/1998 | Miksic et al. | |
| 5,770,286 | A | 6/1998 | Sorkin | |
| 5,840,247 | A | 11/1998 | Dubois et al. | |
| 5,902,958 | A | 5/1999 | Haxton | |
| 6,028,160 | A * | 2/2000 | Chandler et al. | 528/176 |
| 6,174,461 | B1 | 1/2001 | Miksic et al. | |
| 6,342,101 | B1 | 1/2002 | Miksic et al. | |
| 6,354,596 | B1 | 3/2002 | Rodriguez | |
| 6,399,021 | B1 | 6/2002 | Heimann et al. | |
| 6,588,193 | B2 | 7/2003 | Hayes | |
| 6,617,415 | B1 * | 9/2003 | Miksic et al. | 528/190 |
| 6,858,160 | B2 | 2/2005 | Heimann et al. | |
| 7,048,873 | B1 | 5/2006 | Miksic et al. | |
| 7,125,441 | B1 | 10/2006 | Furman et al. | |

FOREIGN PATENT DOCUMENTS

| | | |
|---|---|---|
| JP | 2003-056121 | 2/2003 |

* cited by examiner

*Primary Examiner* — Brent O'Hern
(74) *Attorney, Agent, or Firm* — Haugen Law Firm PLLP

(57) ABSTRACT

A corrosion inhibiting agent is provided as a finely ground powder that is dispensed into a sheath or other casing enclosing a metal bar, cable, or other tension member. The agents are produced by preparing salts of amines with benzoic acid or nitric acid, drying the salts, and grinding and screening the salts to provide a desired maximum particle size. Also disclosed is a dry fogging system through which the powder is applied to metal tension members enclosed in polymeric sheaths or other fluid tight casings.

26 Claims, 2 Drawing Sheets

CORROSION INHIBITING SYSTEMS

This application is a divisional of U.S. patent application Ser. No. 11/559,482, entitled "Corrosion Inhibiting Powders and Processes Employing Powders," filed Nov. 14, 2006.

BACKGROUND OF THE INVENTION

The present invention relates to vapor phase corrosion inhibiting compositions, and more particularly to dry powder inhibitors specifically formulated to provide corrosion protection of metal in recessed areas, e.g. post-tensioning cables inside tubes.

Vapor phase corrosion inhibiting materials are utilized in a variety of applications for protecting metal from corrosion. One such application is a method of prestressing concrete structures, known as post-tensioning. Post-tensioned concrete systems have been used for decades in the construction of bridges, elevated concrete slabs for parking ramps and garages, and in flooring, walls and columns of commercial buildings. In this form of prestressing, cables, strands, bars, or other members of high strength steel are installed at a job site, usually housed in sheathing or tubes that prevent the steel from bonding to the concrete. After the concrete cures, the steel members are stretched by hydraulic jacks. The tensioned members act upon the concrete slab or other structure to place it in compression, considerably improving the capacity of the structure to withstand tensile and bending forces.

A persistent problem with post-tensioned structures and systems is corrosion of the metal members, particularly in environments involving exposure to salts and other de-icing materials, acid rain, airborne salts in locations near the ocean, and high humidity. If undetected or untreated, corrosion can weaken tensioned members to the point of breakage. In typical post-tensioned structures where the cables or other members are not bonded to the surrounding concrete, breakage of a tensioned member can create a risk of serious injury and property damage.

A variety of solutions have been directed to the corrosion problem. For example, U.S. Pat. No. 5,840,247 (Dubois et al.) discloses a process for protecting the tendons embedded in housings by drilling holes in the housings and injecting a corrosion inhibiting liquid solution into the housings while applying a high power pulsating wave to enhance penetration.

U.S. Pat. No. 5,460,033 (VanderVelde) describes processes for corrosion evaluation and protection of unbonded cables. Holes are drilled in the concrete to expose the tendons, and a dry non-corrosive gas is passed through the conduits enclosing the tendons. The patent notes that if the evaluation of the gas indicates a humidity above sixty percent, corrosion will ensue. The humidity preferably is maintained below forty-five percent, by injection of dry nitrogen gas as needed.

U.S. Pat. No. 3,513,609 (Lang) shows tendons coated with a polymeric material such as TEFLON (brand name) polymer or an epoxy resin containing up to twenty-five percent finely ground TEFLON polymer. The tendons are coated with a lubricating grease before they are covered with the plastic.

U.S. Pat. No. 4,442,021 (Bürge, et al.) is drawn to a corrosion protection coating of cement containing up to ten percent corrosion inhibitors. The mixture is applied onto the metallic tendons before their enclosure.

U.S. Pat. No. 5,770,286 (Sorkin) describes a corrosion resistant retaining seal for end caps. The cap, formed of a polymeric material, contains corrosion resistant material inside the cap. The cap is intended to create a water-tight seal. The patent also describes an "ice pick" method of making a hole in the plastic sheath and injecting grease into the sleeve to displace water and prevent corrosion.

U.S. Pat. No. 5,540,030 (Morrow) describes injecting a polyurethane resin into the housing to displace water and air and prevent corrosion.

While the foregoing approaches are acceptable for a variety of applications, none of them is particularly well suited for providing corrosion protection for large scale systems in which the reinforcement members may have considerable length, e.g. exceeding one hundred feet. Drilling holes for injecting anti-corrosive grout or oil becomes prohibitively expensive and time consuming, and corrosion of longer lengths of tensioned members is not adequately addressed by end caps or similarly restricted features. Coating tensioned members directly with anti-corrosive layers or films inhibits corrosion, but is not a practical approach for treating previously installed systems.

Accordingly, the present invention concerns structures, systems, and processes directed to one or more of the following objects:

(1) to facilitate corrosion protection of metal tension members having considerable length, without the need to drill multiple holes along the length of the members to be treated;

(2) to provide a system for treating tensioned reinforcement members in situ in preexisting structures, at low cost and minimal disruption to the structures;

(3) to provide a system particularly well suited for protecting reinforcement members (either before or after they are tensioned) enclosed in relatively tight tubes or sheaths, or having irregular or varying topographies or otherwise forming relatively small or deep voids where exposed metal surfaces are difficult to reach.

SUMMARY OF THE INVENTION

To achieve these and other objects, there is provided a corrosion inhibition system. The system includes an aerosol that occupies substantially the entire interior volume between an elongate metal tension member and a cover surrounding the tension member. The aerosol includes a dry carrier gas, and volatile corrosion inhibiting chemicals having an affinity for metal surfaces.

Preferably the chemicals are particles having diameters of less than 50 microns. The particles can be suspended in the air or other carrier gas, readily move with the gas, and as a result are distributed throughout the interior volume. The particles are able to gain access to deep recesses and voids within the interior volume. The volatile feature of the chemicals facilitates protection of exposed metal surfaces not accessible by other forms of corrosion inhibiting agents. The particles sublimate to provide a vapor that adsorbs on the exposed metal surfaces, forming a thin, monomolecular protective layer that provides continuous protection against corrosion from exposure to moisture, salt, oxygen, carbon dioxide, or other corrosive elements.

If the layer is disturbed by moisture or other corrosive components entering the interior volume, the corrosion inhibiting characteristics remain effective.

In preferred embodiments, the particles consist essentially of the volatile corrosion inhibiting material. The corrosion inhibiting material is formulated in a solid form and dried, then pulverized, and screened to remove particles having diameters larger than the desired threshold size. Suitable volatile corrosion inhibiting agents are selected from the group consisting of cyclohexylammonium benzoate, monoethanolamine benzoate, dicyclohexcyl ammonium nitrate, tolytriazole, benzotriazole, their combinations, and other combinations of corrosion inhibitors such as the amine salts of acids such as sebasic acid and caprylic acid that form solids that can be ground into the desired particle size.

Another aspect of the present invention is a process for treating an elongate metal structural member adapted to provide structural support while in tension. The process includes the following steps:

a. generating an aerosol including a dry carrier gas, and multiple solid-phase particles suspended in the carrier gas and including a volatile corrosion inhibiting agent with an affinity for metal surfaces;

b. introducing the aerosol into an interior of a substantially fluid impermeable casing disposed in surrounding relation to an elongate metal tension member until the aerosol substantially fills an interior volume comprised of the interconnected interstitial voids between the tension member and the casing; and c. with the interior volume substantially filled with the aerosol, closing the casing in a substantially fluid-tight manner to contain the aerosol within the interior volume.

Cables and other tension members can be treated both before and after they are tensioned. Preferably, the aerosol is generated by moving a carrier gas past a collection of the corrosion inhibiting agent particles, to entrain a portion of the particles in the carrier gas. The aerosol is introduced at a positive pressure to the interior volume through an entrance passage near a first end region of the tension member and casing. Simultaneously, the interior volume is evacuated by allowing flow through an exit passage at an opposite end region of the tension member and casing.

The process is effective over a range of particle concentrations in the aerosol. At the minimum, it has been found advantageous to provide a particulate concentration sufficient to facilitate visual recognition of the corrosion inhibiting particles. In such a cases the aerosol has the appearance of a fog or cloud of dust. Then, the emergence of the aerosol out through the exit passage provides a visible signal that the interior volume is substantially filled with the aerosol. At this stage, the entrance and exit passage are closed to seal the aerosol within the interior volume.

Another aspect of the present invention is a process for treating an encased tension member in situ. The process includes the following steps:

a. forming an entrance passage from an exterior of an assembly including a tension member and a fluid impermeable cover to an interior volume between the tension member and the cover;

b. forming an exit passage from the interior volume to the exterior, spaced apart from the entrance passage;

c. generating an aerosol including a carrier gas, and multiple solid-phase volatile corrosion inhibitor particles suspended in the carrier gas;

d. introducing the aerosol into the interior volume through the entrance passage while simultaneously allowing a flow out of the interior volume through the exit passage, to substantially fill the interior volume with the aerosol; and e. with the interior volume substantially filled with the aerosol, closing the entrance passage and the exit passage to maintain the aerosol inside the cover.

The process is particularly well suited for treating previously installed tension members in preexisting structures, particularly when the encased tension members have lengths exceeding 50, 100, and even 150 feet. This is primarily because the only required access to the interior volume inside the cover is an entrance passage formed at one end of the tension member and cover, and an exit passage at the other end. There is no need for intermediate passages for pumping oil or greases into the interior volumes at high pressure. Rather, in accordance with the invention, the aerosol is provided into the interior volume through the entrance passage at low pressure, for example using a conventional air hose at a pressure of less than 100 psi. The particles advance through the interior volume lengthwise of the tension member due to the continued positive pressure, while gases previously present in the interior volume flow out of the interior volume through the exit passage.

Further aspects of the present invention include a system for treating an elongate structural member in situ, and a corrosion resistant system.

Thus, in accordance with the present invention, a relatively simple and low cost method of fogging encased tension members can be utilized both before and after the members are initially tensioned, or in the course of normal inspection of previously installed tension members years after a project is completed. In either event, the corrosion protection is enhanced by the capacity of the corrosion inhibiting particles to migrate into deep recesses and voids to reach virtually all exposed metal surfaces.

IN THE DRAWINGS

Further features and advantages will become apparent upon consideration of the following detailed description and drawings, in which.

DETAILED DESCRIPTION OF THE PREFERRED EMBODIMENTS

Figure 1:
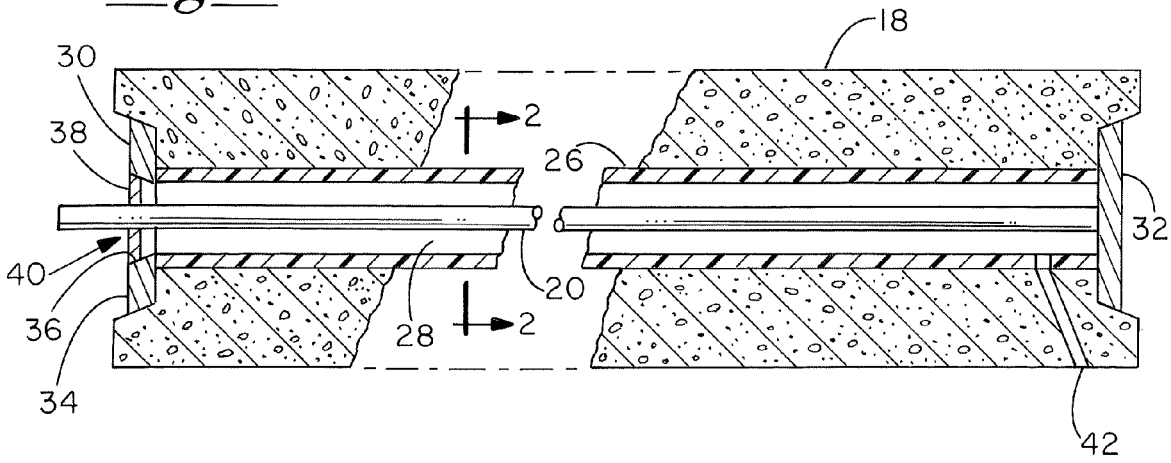
FIG. 1 is a sectioned elevational view of a concrete structure reinforced with a post-tensioned cable treated in accordance with the present invention.
Figure 2:
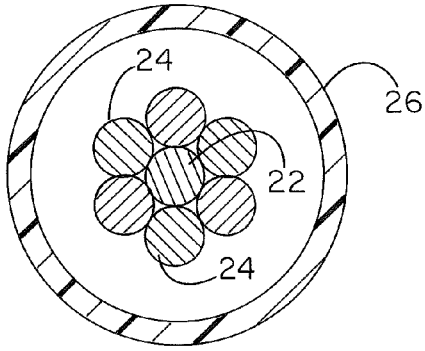
FIG. 2 is a sectional view taken along the line 2-2 in FIG. 1.
Figure 3:
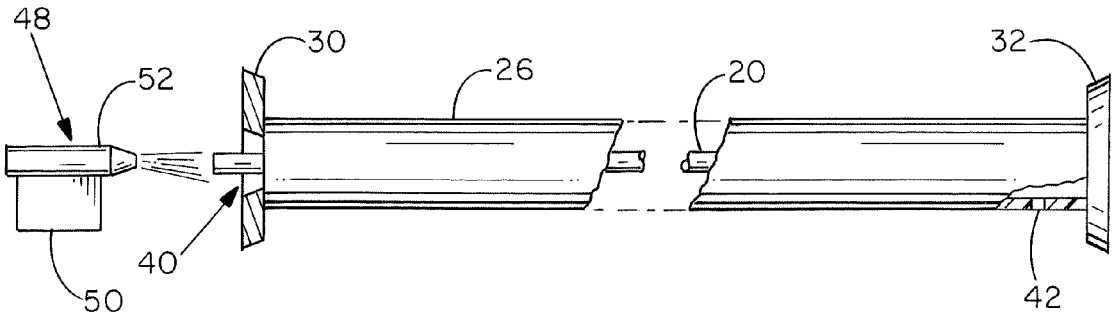
FIG. 3 is a schematic view illustrating a process for treating metal tension members in the course of forming reinforced concrete structures in accordance with the present invention.

Turning now to the drawings, there shown in FIGS. 1-3, a post-tensioning assembly 16 employed to prestress a concrete slab 18. The concrete slab maybe a section of a bridge, a parking deck or ramp, wall, floor, or any other structure in which structural sections can be formed of reinforced concrete.

The assembly includes an elongate tension member in the form of a high-strength steel cable 20 consisting of a center strand 22 surrounded by six peripheral strands 24 wound in a tight helical configuration about center strand 22. In alternative embodiments, the tension member may be a rod, bar, single strand, or plurality of strands, either unwound or wound in a configuration other than a helical configuration of strands 24.

Cable 20 is housed within a sheath 26. The sheath provides a cover or casing that surrounds the cable over the complete length of the cable contained within slab 18. Sheath 26 ensures that cable 20 remains unbonded, i.e. free to move axially relative to the slab, to permit stretching the cable to place it under tension to prestress the slab. Sheath 26 typically is formed of a polymeric material, and provides a substantially fluid impermeable barrier between slab 18 and cable 20.

Sheath 26 tends to isolate the cable and the enclosed sheath interior space, i.e. an interior volume 28, from the outside environment.

While this fluid isolation provides a degree of protection against corrosion of the steel, corrosive components can and do infiltrate the interior volume. Accordingly, in conventional post-tensioning systems, it is known to inject corrosion inhibiting greases into the interior volume to reduce and counteract such exposure. These greases, however, tend to harden and dry, and even at the outset may fail to reach exposed metal surfaces in deep pockets or crevices of the interior volume.

Typically, post-tensioning systems employing multiple assemblies such as assembly 16 are installed on a job site, by positioning the cables or other tendons and their surrounding sheaths before the concrete is poured. At their opposite ends, the cables are secured by anchors, as indicated with respect to cable 20 by opposite anchors 30 and 32. Anchor 30 includes an anchoring body 34 having a frusto-conical central opening 36 surrounding cable 20 and containing several anchoring wedges 38. Wedges 38, in the manner known in the art, allow cable 20 to be stretched axially, to the left as viewed in FIG. 1, whereupon the wedges converge to secure the stretched cable against slippage relative to anchor 30.

In contrast, the opposite end of cable 20 is fixed with respect to anchor 32. In alternative systems, it may be advantageous or desirable to use anchors such as anchor 30 at both ends, to allow tensioning of the cable at either end of slab 18.

The concrete is allowed to cure before the cables of the prestressing system are stretched. With a specific reference to cable 20, anchors 30 and 32 secure the opposite cable ends, and are adapted to apply compressive forces to the slab to counterbalance the tension of cable 20 when stretched. A hydraulic jack or other equipment (no shown) is used to stretch the cable to the desired tension. Locking wedges 38 maintain the desired tension after the jack is disconnected from the cable.

One of the problems associated with using grease as the corrosion inhibiting medium is the difficulty in filling the interior volume with the medium, primarily due to its high viscosity. This problem is particularly pronounced in larger reinforced concrete structures, where cables may exceed one hundred fifty feet in length. While multiple access holes can be drilled along the length of the cable, as taught in the aforementioned Morrow '030 and Dubois '247 patents, this approach adds considerable time and cost to the project, and provides more potential paths for corrosive element infiltration.

In accordance with present invention, the preferred medium for delivering corrosion inhibiting agents to interior volume is an aerosol: more particularly, a non-reactive carrier gas with multiple volatile corrosion inhibiting particles suspended in the carrier gas.

Corrosion inhibiting chemicals useful for volatizing or sublimating can be prepared by reacting amines with acids. A useful mixture of inhibitors can be formed from cyclohexylammonium benzoate, monoethanolamine benzoate and a small amount amorphous silica. Monoethanolamine benzoate functions well, as does dicyclohexyl ammonium nitrate. Further well-functioning inhibitors include benzotriazole and the monoethanolamine salt of benzo- or tolyltriazole. Sodium nitrate also can be used.

Suitable corrosion inhibiting agents are formulated by preparing the salts of several amines with benzoic acid or nitric acid, according to the following examples:

Example 1

| Constituent | Percent by Weight |
|---|---|
| Cyclohexylammonium Benzoate | 87 |
| Monoethanolamine Benzoate | 10 |
| Amorphous Silica | 3 |

Example 2

| Constituent | Percent by Weight |
|---|---|
| Cyclohexylammonium Benzoate | 60 |
| Monoethanolamine Benzoate | 20 |
| Dicyclohexcyl Ammonium Nitrate | 20 |

Example 3

| Constituent | Percent by Weight |
|---|---|
| Cyclohexylammonium Benzoate | 55 |
| Monethanolamine Benzoate | 20 |
| Dicyclohexcyl Ammonium Nitrate | 20 |
| Benzotriazole | 5 |

It is advantageous that the mixtures of inhibitor powders are dried and screened to an average particle size of about 0.2 mm. The screened particles are then subjected to a further size-reduction stage, specifically pulverizing/grinding in a model DPM-1 Dense Phase Mill pulverizing system available from CCE Technologies, Inc. of Cottage Grove, Minn. Then, the particles are screened further using a screen pore size of 50 micrometers, such that the resulting powder is made up of particles with diameters less than 50 microns. The screening to remove larger particles is particularly useful to prevent formation of piles or blocks that might interfere with flow of the gas and particles through the interior volume.

To facilitate loading the aerosol into interior volume 28, entrance and exit passages are disposed at the opposite ends of the sheath and cable. An entrance passage 40 is provided in the form of gaps between adjacent wedges 38. At the opposite end where cable 20 and anchor 32 are integrally coupled, an exit passage 42 is formed through concrete slab 18.

When interior volume 28 is filled with the aerosol, the entrance and exit passages are sealed to contain the aerosol. The volatile particles sublimate, resulting in a corrosion inhibiting vapor that adsorbs on the exposed metal surfaces, forming a thin, molecular layer that provides both cathodic and anodic protection.

FIG. 3 illustrates a fogging process used to load the corrosion inhibiting aerosol into interior volume 28. An aerosol generator 48 is used to introduce the aerosol into the internal volume through entrance passage 40 under a positive pressure. Generator 48 includes a container 50 of the particles and a nozzle 52 coupled to receive air under pressure from a source not shown, e.g. a conventional air hose. The flow of air toward and through nozzle 52 creates a negative pressure that draws the corrosion inhibiting particles upwardly into the conduit and through the nozzle.

The aerosol proceeds axially through interior volume 28. The flow of the aerosol may be laminar or more turbulent, depending largely upon the shape of the internal volume. In either event, as the aerosol advances through the interior volume, the air or other gas previously in the volume is displaced, and leaves the volume through exit passage 42.

The introduction of the aerosol continues until the aerosol substantially fills the interior volume. This event is detectable visually, upon observing that the aerosol, rather than the air or other gas previously in the interior volume, is leaving the volume through the exit passage.

The fogging process is effective over a range of particle concentrations. A preferred minimum particle concentration is the concentration at which the aerosol is easily observed leaving the interior volume, thus to facilitate determining when the interior volume is filled. Particle concentrations preferably are kept below levels at which the particle density might interfere with or impede flow through the interior volume.

After fogging, the entrance and exit passages are closed to contain the aerosol in the interior volume. Fogging can be employed before cable 20 and the other cables in the post-tensioning system are tensioned, and/or at a later stage such as after tensioning and sealing.

An important factor influencing aerosol flow is particle size. By providing particles with diameters less than a predetermined threshold, preferably 50 microns, particles can be generated at higher densities without impeding the aerosol flow, and the smaller particles are better suited to reach relatively inaccessible areas.

Figure 4:
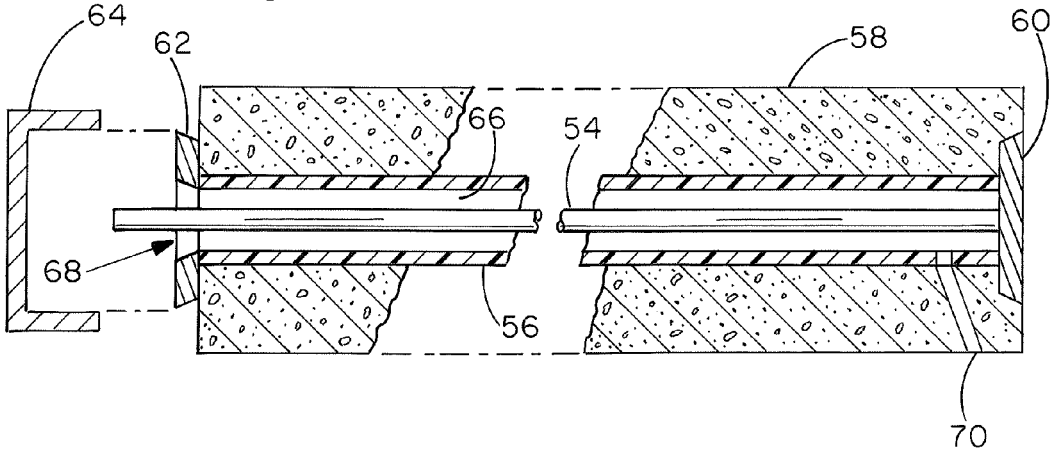
FIG. 4 schematically illustrates a process for treating the metal tension members of a prestressed concrete structure in situ according to the invention.

One advantage of the present invention is the capacity to treat post-tensioning assemblies in previously installed reinforced concrete structures. FIG. 4 illustrates a tension cable 54 surrounded by sheath 56 embedded in a concrete slab 58. Cable 54 acts through anchors 60 and 62 to apply compressive forces to the concrete slab. Cable 54 is attached integrally to anchor 60 and secured to anchor 62 through wedges or other structure that permits axial movement to stretch the cable, as before. Anchor 62, and an end region of cable 54 extending beyond anchor 62, are enclosed by an end cap 64, for example of the type disclosed in U.S. Pat. No. 5,770,286. Anchor 60 likewise, may be covered with an end cap, although this is not illustrated.

Corrosion inhibiting treatment of cable 54 begins with formation of opposite end entrance and exit passages in fluid communication with an interior volume 66. The entrance passage 68 is formed by removing end cap 64, and may also require removal of the grease from between adjacent wedges.

The exit passage is drilled through the concrete and sheath, as indicated at 70. At this stage, the corrosion inhibiting aerosol is introduced into the internal volume, as before. The passages can be functionally reversed if desired, with the aerosol provided under positive pressure through passage 70, with displaced gasses leaving through the gaps between the wedges. In either event, once the internal volume is filled with the aerosol, passage 68 is closed and sealed, using an end cap if desired, and passage 70 is closed and sealed with a corrosion inhibiting grout.

In cases where there are no end caps, the entrance and exit passages are formed by drilling through the concrete and sheath, and sealed with corrosion inhibiting grout after the aerosol is introduced.

Thus in accordance with the present invention, corrosion inhibiting agents are applied through a fogging process that distributes a particulate suspension of a corrosion inhibiting agent throughout an enclosed space surrounding a cable, bar or other tension member providing post-tensioning or other structural support. The process is relatively simple and low cost, yet provides substantially complete coverage of exposed metal surfaces for effective and long-term corrosion protection. The fogging process can be integrated into the fabrication of reinforced concrete structures and other structural components, or may be applied in situ to previously completed structures.

What is claimed is:

1. A corrosion inhibition system, including:

an elongate metal structural member, a cover disposed in surrounding relation to the structural member and cooperating with the structural member to define an interior volume between the structural member and the cover, and an aerosol occupying substantially the entire interior volume;

wherein the aerosol includes a carrier gas; and a volatile corrosion inhibiting agent suspended in the carrier gas, said volatile corrosion inhibiting agent having an affinity for metal surfaces.

2. The system of claim 1 wherein:

the volatile corrosion inhibiting agent is selected from the group of constituents consisting of: cyclohexylammonium benzoate, monoethanolamine benzoate, dicyclohexcyl ammonium nitrate, benzotriazole, tolytriazole, amine salts of caprylic acid and sebasic acid, and their combinations.

3. The system of claim 2 wherein:

the volatile corrosion inhibiting agent comprises at least two different volatile corrosion inhibiting constituents.

4. The system of claim 1 further including:

solid-phase particles of amorphous silica suspended in the carrier gas.

5. The system of claim 1 wherein:

the volatile corrosion inhibiting agent is present in the form of multiple solid-phase particles.

6. The system of claim 5 wherein:

the solid-phase particles have diameters of less than 50 microns.

7. The system of claim 5 wherein:

the solid-phase particles are present in the aerosol at a concentration selected to facilitate visual recognition of the aerosol.

8. The system of claim 1 further including:

a first anchoring member secured to a first end region of the structural member and a second anchoring member secured to a second and opposite end region of the structural member, wherein the anchoring members cooperate to maintain the structural member in tension.

9. The system of claim 8 wherein:

the first and second anchoring members are engaged with opposite sides of a concrete structure surrounding the structural member and the cover, whereby the structural member applies a compressive force to the concrete structure through the anchors.

10. The system of claim 9 wherein:

the first anchoring member and the structural member are secured in a manner that permits axial movement of the structural member relative to the first anchoring member to adjust the tension along the structural member.

11. The system of claim 1 wherein:

the casing is substantially fluid impermeable.

12. A system for treating, in situ, an elongate structural member surrounded by a substantially fluid impermeable casing, the system including:

a substantially fluid impermeable casing, and means defining an entrance passage extending from an exterior of the casing to an interior volume between the casing and an elongate metal structural member surrounded by the casing, the entrance passage being disposed near a first end region of the structural member;

means defining an exit passage extending from the exterior of the casing to the interior volume, disposed near a second and opposite end region of the structural member;

an aerosol source for generating an aerosol that includes a carrier gas and a volatile corrosion inhibiting agent suspended in the carrier gas and having an affinity for metal surfaces, and for effecting an entry of the aerosol into the interior volume through the entrance passage to displace gas previously in the interior volume via a flow out of the interior volume through the exit passage; and an aerosol containment mechanism for closing the entrance passage and the exit passage after said entry to contain the aerosol within the interior volume.

13. The system of claim 12 wherein:

the volatile corrosion inhibiting agent is selected from the group of constituents consisting of: cyclohexylammonium benzoate, monoethanolamine benzoate, dicyclohexcyl ammonium nitrate, benzotriazole, tolytriazole, amine salts of caprylic acid and sebasic acid, and their combinations.

14. The system of claim 13 wherein:

the volatile corrosion inhibiting agent comprises at least two different volatile corrosion inhibiting constituents.

15. The system of claim 12 wherein:

the volatile corrosion inhibiting agent is present in the form of multiple solid-phase particles.

16. The system of claim 15 wherein:

the solid-phase particles have diameters of less than 50 microns.

17. The system of claim 15 wherein:

the solid-phase particles are present in the aerosol at a concentration selected to facilitate visual recognition of the aerosol.

18. The system of claim 12 wherein:

the containment mechanism comprises a cap mounted near the first end of the structural member to cover the entrance passage.

19. The system of claim 12 wherein:

the containment mechanism comprises a corrosion inhibiting grout inserted into at least a selected one of the entrance and exit passages to seal the selected passage.

20. The system of claim 12 further including:

a first anchoring member secured to the structural member at the first end region and a second anchoring member secured to the structural member at the second end region, said anchoring members cooperating to maintain the structural member in tension while simultaneously applying a compressive force to a concrete structure surrounding the structural member and the casing;

wherein the entrance passage is formed through the first anchoring member.

21. A corrosion resistant system, including:

an elongate metal structural member;

an elongate cover disposed in surrounding relation to the structural member, and cooperating with the structural member to define an interior volume between the structural member and the cover; and a volatile corrosion inhibiting agent having an affinity for metal surfaces, provided to the interior volume as an aerosol to distribute the volatile corrosion inhibiting agent substantially throughout the entire interior volume, wherein at least a portion of the volatile corrosion inhibiting agent is adsorbed onto exposed metal surfaces of the structural member to inhibit corrosion of the structural member.

22. The system of claim 21 wherein:

the aerosol is comprised of multiple solid-phase particles of the volatile corrosion inhibiting agent suspended in a carrier gas.

23. The system of claim 22 wherein:

the solid-phase particles have diameters of less than 50 microns.

24. The system of claim 21 wherein:

the volatile corrosion inhibiting agent is selected from the group of constituents consisting of: cyclohexylammonium benzoate, monoethanolamine benzoate, dicyclohexcyl ammonium nitrate, benzotriazole, tolytriazole, amine salts of caprylic acid and sebasic acid, and their combinations.

25. The system of claim 21 further including:

first and second anchoring members secured to opposite end regions of the structural member and cooperating to maintain the structural member in tension.

26. The system of claim 21 wherein:

the cover is closed to contain the volatile corrosion inhibiting agent within the interior volume.

* * * * *

UNITED STATES PATENT AND TRADEMARK OFFICE

CERTIFICATE OF CORRECTION

PATENT NO. : 8,603,603 B2
APPLICATION NO. : 13/022401
DATED : December 10, 2013
INVENTOR(S) : Jessica Jackson Meyer et al.

It is certified that error appears in the above-identified patent and that said Letters Patent is hereby corrected as shown below:

In the Claims:

In Claim 1, at column 8 line 23:
Please replace "wherein the aerosol includes a carrier gas; and a volatile" with --wherein the aerosol includes a carrier gas and a volatile--

Signed and Sealed this
Eighteenth Day of February, 2014

Michelle K. Lee

Michelle K. Lee
*Deputy Director of the United States Patent and Trademark Office*